United States Patent [19]

Nakamura et al.

[11] 4,424,060

[45] Jan. 3, 1984

[54] METHOD FOR TREATING FABRIC TO IMPART WASHFAST AND ANTIBIOSIS THERETO

[76] Inventors: Shinichi Nakamura, 8-505 Satsukigaoka 1-Chome, 29 Gaiku, Chiba-Shi, Chiba-Ken; Riuzo Huzita, 14-2 Higashi Ohwada 2-Chome,, Ichikawa-shi, Chiba-Ken; Iwao Kamitani, 16-10 Higashi Ohgu 5-Chome,, Arakawa-Ku, Tokyo; Tetsuma Maeda, 1519-12 Kamiyabe-Cho, Totsuka-ku,, Yokohama-Shi, Kanagawa-Ken, all of Japan

[21] Appl. No.: 446,359

[22] Filed: Dec. 2, 1982

[30] Foreign Application Priority Data

Dec. 2, 1981 [JP] Japan ..... 56-192796

[51] Int. Cl.[3] ..... D06M 13/48; D06M 3/02; D06M 1/00; D06M 3/30

[52] U.S. Cl. ..... 8/115.5; 8/191; 8/127.6

[58] Field of Search ..... 8/191, 127.6, 115.5

[56] References Cited

U.S. PATENT DOCUMENTS

| | | | |
|---|---|---|---|
| 2,314,968 | 3/1943 | Bestian et al. | 8/191 |
| 2,694,696 | 11/1954 | Melamed | 8/191 |
| 3,038,776 | 6/1962 | Chance et al. | 8/191 |
| 3,627,631 | 12/1971 | Sprenger | 8/191 |
| 3,642,571 | 2/1972 | Sprenger | 8/191 |

OTHER PUBLICATIONS

Pingree, R. A., *Amer. Dyestuff Reporter,* Mar. 1946.

*Primary Examiner*—Maria Parrish Tungol
*Attorney, Agent, or Firm*—Armstrong, Nikaido, Marmelstein & Kubovcik

[57] ABSTRACT

A method for treating a fabric by the combined use of a permanent water repellent and softening agent and at least one of a sterilizing compound and a mould retardation compound so that the fabric is imparted washfast and antibiosis thereto which are maintained even after a number of washings.

12 Claims, No Drawings

METHOD FOR TREATING FABRIC TO IMPART WASHFAST AND ANTIBIOSIS THERETO

BACKGROUND OF THE INVENTION

This invention relates to a method for treating fiber products or fabrics to impart washfast and antibiosis to the fabrics by the use of a conventional sterilizing compound and/or a mould retardation compound which have been commonly used in such treatment of the fabrics in combination of a known alkylethylene urea as the permanent water repellent and softening agent.

As well known in the art, fiber products whether they are formed of natural or synthetic fibers are subjected to various damages by harmful microorganisms after they have been used for their respectively intended purposes for a certain period of time. Especially, fiber products or fabrics which are adapted to directly contact the skin such as underwears, stockings, socks, panty-stockings, sports undershirts, sports shoes, rubber boot linings and the like, for example, assist the growth and propagation of microorganisms, emit offensive smell and/or become stained resulting in the deterioration of the textures of the fabrics after they have been worn for a certain period of time. And sheets, mattresses, blankets and the like which are used in hospitals and the like facilities are vulnerable to taint by microorganisms. Furthermore, carpets and the like are said as the hotbeds for the growth and propagation of bacteria. Thus, fiber products or fabrics are easily subjected to damages by harmful microorganisms and/or bacteria when they are used for daily living activity. Especially, peculiar wheather conditions such as high temperature and moisture in Japan are optimum for the growth and propagation of microorganisms and bacteria. Microorganisms and bacteria not only emit offensive smell which give discomfort to others, but also attack persons with cutitis and water-eczema and advance such skin diseases. During the storage of ordinary fabrics and when wet tents and sheets and sweat-moisten undershirts are left as they are for a certain period of time, they become discolored and/or stained and in an extreme case, the fibers of the fabrics may be deteriorated to the degree that the fabrics cannot be reused. Fishing implements such as fishing nets and ropes are frequently affected by sea water and/or damaged by duckweeds and the like underwater livings.

In order to protect fiber products or fabrics from damages by microorganisms and bacteria as mentioned hereinabove, a variety of sterilizing and mould retardation agents with which fabrics are treated have been known. The known sterilizing agents are alkyl dimethyl benzylammonium chloride and chlorohexadine digluconate as water-soluble sterilizing agents and P-chloro-m-xylenol as water-insoluble sterilizing agent, for example. The known mould retardation agents are 2,4,5,6-tetrachloroisophthalonitrile, N(fluorodichloromethylthio)phthalimide, zinc-2-pyridinethiol-1-oxide, 2-(4-thiazolyl)benzimidazol, α-bron cynnamic aldehyde and p-phdroxy benzoic acid ester as water-insoluble mould retardation agents, for example. The prior art sterilizing and mould retardation agents have attained their intended purpose to some degree.

However, it has been found that the prior art sterilizing and mould retardation agents scarcely give washfast to fiber products or fabrics and one washing of fabrics washes the sterilizing and mould retardation agents away from the fabrics. When tents and sheets are treated with the prior art sterilizing and mould retardation agents, has been found that the tents and sheets are once used in water, the agents are washed away from the tents and sheets and the effectiveness of the use of such agents on the fabrics is lost. It may be considered that the tents and sheets are treated with the sterilizing and detardation agents each time they were used in water, but such repeated treatment is almost impossible.

Although it has been proposed that fiber products or fabrics are treated with sterilizing and mould retardation agents at regular time spaces to always maintain the fabrics under sanitary conditions, such approach has been found as impractical.

SUMMARY OF THE INVENTION

Therefore, the present invention is to provide a method for treating fiber products or fabrics so as to impart washfast and antibiosis to the fabrics.

PREFERRED EMBODIMENTS OF THE INVENTION

According to the present invention, in order to give washfast and antibiosis to fiber products or fabrics, the fabrics are treated with the combination of conventional sterilizing and mould retardation agents which have no washfast and a conventional permanent water repellent and softening agent such as alkylethylene urea so that the fabrics are imparted washfast and antibiosis thereto.

Alkylethylene urea is expressed by the following general formula:

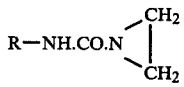

wherein R is $C_{2-18}$ alkyl group and the alkylethylene urea can be easily obtained by synthesizing alkylisocyanate and ethyleneimine as expressed by the following formula:

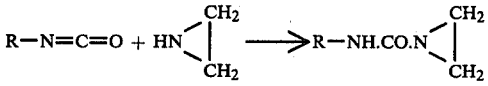

The alkylethylene urea effects a chemical reaction with natural and synthetic fiber fabrics having hydroxyl radicals or amino radicals to chemically bond therewith as expressed by the following formula to thereby give washfast to the fabrics.

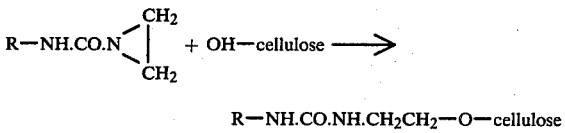

After the treatment of the fabric with the combination of sterilizing and mould-retardation agents and alkylethylene urea as mentioned hereinabove, the fabric is pre-dried at 60°–80° C. for a time period which varies depending upon the type of the fabric to be treated and then cured at 110°–150° C. for 3–15 minutes to thereby give washfast and antibiosis to the fabric.

Compounds in which the alkylethylene urea has a short chain of alkyl radicals imparts fabrics with shrink, elongation and deformation proof properties. On the other hand, compounds in which the alkylethylene urea has a long chain of alkyl radicals impart fabrics with permanent water repellent and softening properties.

The urea radical contained in alkylethylene urea tends to adhere to the individual fibers of fabrics and effect polymerization with the fibers to some degree, that is:

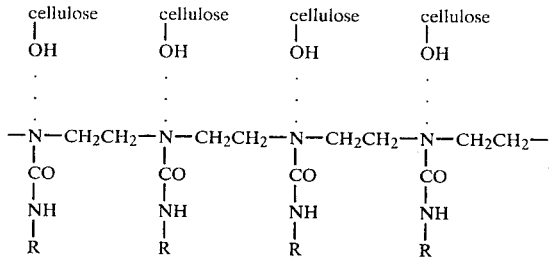

In this case, the sterilizing and mould retardation agents are bonded with the alkylethylene urea so that the agents are partially covered by the alkylethylene urea. Alternatively, when the sterilizing and mould retardation agents have hydroxyl radical or amino radical, it is thought that mutual chemical bonding and polymerization take place between the alkylethylene urea and the cellulose in the fibers of the fabric. As a result, it is thought that the sterilizing and mould retardation agents come to gradually appear onto the surface of the fabric as the chemical bonding and polymerization progress and the effectiveness of the agents on the fabric is maintained for a long period even after repeated washing of the fabric which was treated with the agents.

The fabric treated by the method of the present invention can stand washing up to 100 times or more without losing the washfast and antibiosis against *Staphylococcus aureus* and *Trichophyton mentagrophytes* and up to 50–80 times against a dormant bacillus such as *Escherichia coli.* And such treated fabric can stand dry cleaning over 50 times.

Sterilizing and mould retardation agents useful in the present invention include a variety of compounds including water soluble and insoluble compounds as mentioned hereinabove. The sterilizing and mould retardation agents applicable to garments, beddings and the like which directly contact the skin should be, of course, selected from safe agents such as low toxic and non-accumulative agents. And for the application to tents, sheets, fishing implements, general industrial sterilizing and mould retardation agents can be suitably employed. The amount of such agents is within the range of 0.005–10% by weight and preferably within the range of 0.05–3.0% by weight based on the weight of the fabric which is treated by the agents. The sterilizing and mould retardation agents may be employed in the form of an aqueous solution, a solution in an organic solvent, an aqueous solution with a surface active agent added thereto or an emulsion in water. When sterilizing and mould retardation agents are compounds which are hard to be dissolved in water or organic solvents, such compounds are first ground into fine particles and then dissolved in water or organic solvents.

The amount of alkylethylene urea to be used in the present invention is within the range of 0.1–10% by weight and preferably within the range of 0.5–5% by weight based on the weight of the fabric. The alkylethylene urea is employed in the form of an emulsion with a surface active agent added thereto.

The fiber products or fabrics to be treated by the method of the present invention include cotton, hemp, stable fiber, viscose, silk, wool, natural fiber and nylon products. In addition, almost all fabrics formed of fibers having hydroxy radicals or amino radicals can be employed.

The present invention will be now described referring to specific examples thereof, but it should be understood that the present invention is not in any way limited to the examples.

EXAMPLE 1

200 g of octadecyl ethylene urea, 50 g of 2,4,4'-trichloro-2'-hydroxy-diphenyl ether as the sterilizing agent, 30 g of methoxycarbonyl aminobenzimidasol-4-n-dodecyl bensole sulfonate as the mould detardation agent, 200 g of ethylene glycol monoethyl ether acetate, 200 g of ethanol and 100 g of dinonylphenol polyethylene glycol (10 mol) are admixed to provide a blend and the blend is dispersed in water in an amount sufficient to provide 1,000 g of an emulsion. Since the blend is dispersed in the water, the blend was applied to various fabrics to treat them. The treated fabrics were washed and examined for their washfast and antibiosis against various vacilli. For comparison purpose, controls were treated with an emulsion of substantially similar to the emulsion of the invention described hereinabove in Example 1 except for the exclusion of octadecyl ethylene urea therefrom.

| Test Conditions | | |
|---|---|---|
| 1. | Fabrics subjected to test | Cotton broad fabric (count 40), nylon fabric, acryl fabric and wool muslin |
| 2. | Treatment conditions by agents | Concentration 5%<br>Squeezing 100%<br>Pre-drying: 60° C. for 10 min.<br>Curing: 120° C. for 3 min. |
| 3. | Washing conditions | |
| | Facility | Domestic washing machine |
| | Detergent | New beads 1 g/1l of water (commercially available detergent principally comprising alkyl benzene sulfonate and alkyl sulfonate and sold by Kao Soap K.K. in Japan) |
| | Washing time | 40° C. for 10 minutes |
| | Water washing | Washing by overflowing water for 5 minutes. |
| | The washing was repeated 100 times for each fabric under the above-mentioned conditions and the fabrics were tested after each washing thereof for their washfast and antibiosis. | |
| 4. | Dry cleaning test conditions | |
| | Testing machinery | SOFSPRA for 4 kg load (trade name of a machinery manufactured and sold by Cook Machinery Co., Ltd., in Japan) |
| | Solvent | Perchloroethylene |
| | Detergent | Charge soap (petroleum sulfonate) |
| | Concentration of detergent | 1% (V %) |
| | Cleaning time | 8 minutes |
| | Dehydration | 2.5 minutes |
| | Drying | 60° C. for 20 minutes |
| | Deodorization | Blowing off solvent by air jet for 2 minutes |
| | Dry cleaning was conducted 50 times for each fabric | |

-continued

| Test Conditions | |
|---|---|
| under the above-mentioned dry cleaning conditions and the fabrics were tested for their washfast and antibiosis after each dry cleaning thereof. | |
| Bacilli used | *Escherichia coli* 0-16<br>*Staphylococcus aureus* 20 9p<br>*Trichophyton mentagrophytes* |

Each of the above-mentioned bacilli was inoculated into a culture bed, a piece of fabric was laid on the culture bed, the bacillus was cultured and the stain of the fabric was determined by the growth degree of the bacillus on the fabric. *Eschericha coli* 0-16 and *Staphylococcus aureus* 209 P were cultured at 37° C. for 24 hours and *Trichophyton mentagrophytes* was cultured at 28° C. for 168 minutes. The results of the tests are given in the following Table 1.

TABLE 1

| | | Frequency of Washing | | | | | | | | | | | | | | | |
|---|---|---|---|---|---|---|---|---|---|---|---|---|---|---|---|---|---|
| | | Fabric Treated by Invention | | | | | | | | | | | | Control | | | |
| Fabric | Bacillus | 0 | 5 | 10 | 20 | 30 | 40 | 50 | 60 | 70 | 80 | 90 | 100 | 0 | 1 | 3 | 5 |
| Cotton broad | *Staphylococcus aureus* | 8 | 3 | 1 | 0.5 | 0.5 | 0.5 | 0.5 | 0.5 | 0.5 | 0.5 | 0.5 | 0.5 | 8 | 0 | 0 | 0 |
| | *Escherichia coli* | 6 | 2 | 0.5 | 0.5 | 0.5 | 0.5 | 0.2 | 0.2 | 0 | 0 | 0 | 0 | 6 | 0 | 0 | 0 |
| | *Trichophyton mentagrophytes* | — | — | — | — | — | — | — | — | — | — | — | — | — | + | + | + |
| Nylon | *Staphylococcus aureus* | 10 | 3 | 2 | 1 | 0.5 | 0.5 | 0.5 | 0.5 | 0.5 | 0.5 | 0.5 | 0.5 | 10 | 0 | 0 | 0 |
| | *Escherichia coli* | 8 | 3 | 2 | 1 | 0.5 | 0.5 | 0.5 | 0.2 | 0.2 | 0 | 0 | 0 | 8 | 0 | 0 | 0 |
| | *Trichophyton mentagrophytes* | — | — | — | — | — | — | — | — | — | — | — | — | — | + | + | + |
| Acryl | *Staphylococcus aureus* | 10 | 3 | 1 | 1 | 0.5 | 0.5 | 0.5 | 0.5 | 0.5 | 0.5 | 0.5 | 0.5 | 10 | 0 | 0 | 0 |
| | *Escherichia coli* | 8 | 2 | 1 | 1 | 0.5 | 0.5 | 0.5 | 0.2 | 0.2 | 0 | 0 | 0 | 8 | 0 | 0 | 0 |
| | *Trichophyton mentagrophytes* | — | — | — | — | — | — | — | — | — | — | — | — | — | + | + | + |
| Wool muslin | *Staphylococcus aureus* | 7 | 2 | 1 | 1 | 0.5 | 0.5 | 0.5 | 0.5 | 0.5 | 0.5 | 0.5 | 0.5 | 7 | 0 | 0 | 0 |
| | *Escherichia coli* | 6 | 2 | 1 | 0.5 | 0.5 | 0.5 | 0.2 | 0.2 | 0 | 0 | 0 | 0 | 6 | 0 | 0 | 0 |
| | *Trichophyton mentagrophytes* | — | — | — | — | — | — | — | — | — | — | — | — | — | + | + | + |

Remarks:

Numerals relating to *Staphylococcus aureus* and *Escherichia coli* represent the effective distance in terms of mm from the periphery of the fabric under test laid on the culture bed formed of agar-agar for retarding the propagation of the bacilli. The distance of zero shows no effectiveness in the retardation of the bacillus propagation. As to the effectiveness for retarding the propagation of *Trichophyton mentagrophytes,* symbols — and + mean "effective" and "ineffective", respectively.

From the results of the tests as shown in the above Table 1, it is clear that the fabrics treated by the method of the present invention retain their washfast and antibiosis against *Staphylococcus aureus* and *Trichophyton mentagrophytes* which are the sources of offensive smell emission even after the hundredth washing of the fabrics and the fabrics still show their washfast and antibiosis against *Escherichia coli* after they were washed 60-70 times. On the other hand, the controls lost their washfast and antibiosis against the above-mentioned three types of bacilli when they were washed once.

EXAMPLE 2

220 g of isooctyl ethylene urea, 50 g of 2,4,4'-trichloro-2'-hydroxydiphenylether as the sterilizing agent, 30 g of N-dimethyl-N'-phenyl-N'-(phlorochloromethyl) thiosulfamide as the mould retardation agent, 300 g of ethylene glycolmonoethyl ether acetate and 100 g of ethanol are admixed to provide a blend. The blend is added thereto 150 g of dinonylphenyl polyethyleneglycol (10 mol) as the emulsifier and then gradually added thereto water in an amount sufficient to provide 1,000 g of an emulsion under agitation. The thus obtained emulsion was applied to fabrics to treat the fabrics under the same conditions as described in connection with Example 1 and the treated fabrics were tested for their washfast and antibiosis. For comparison purpose, controls were treated with a treatment emulsion similar to the treatment emulsion of the invention except for the exclusion of isooctyl ethylene urea therefrom using the same test conditions as used for testing the fabrics by the present invention. The results of the tests are shown in the following Table 2.

TABLE 2

| | | Frequency of Washing | | | | | | | | | | | | | | | |
|---|---|---|---|---|---|---|---|---|---|---|---|---|---|---|---|---|---|
| | | Fabric Treated by Invention | | | | | | | | | | | | Control | | | |
| Fabric | Bacillus | 0 | 5 | 10 | 20 | 30 | 40 | 50 | 60 | 70 | 80 | 90 | 100 | 0 | 1 | 3 | 5 |
| Cotton broad | *Staphylococcus aureus* | 7 | 2 | 2 | 1 | 0.5 | 0.5 | 0.5 | 0.5 | 0.5 | 0.5 | 0.5 | 0.5 | 7 | 0 | 0 | 0 |
| | *Escherichia coli* | 6 | 1.5 | 1 | 0.5 | 0.5 | 0.5 | 0.5 | 0.2 | 0.2 | 0 | 0 | 0 | 6 | 0 | 0 | 0 |
| | *Trichophyton mentagrophytes* | — | — | — | — | — | — | — | — | — | — | — | — | — | + | + | + |
| Nylon | *Staphylococcus aureus* | 8 | 3 | 1.5 | 1 | 1 | 0.5 | 0.5 | 0.5 | 0.5 | 0.5 | 0.5 | 0.5 | 8 | 0 | 0 | 0 |
| | *Escherichia coli* | 8 | 3 | 2 | 1 | 0.5 | 0.5 | 0.5 | 0.5 | 0.5 | 0.2 | 0 | 0 | 8 | 0 | 0 | 0 |
| | *Trichophyton mentagrophytes* | — | — | — | — | — | — | — | — | — | — | — | — | — | + | + | + |
| Acryl | *Staphylococcus aureus* | 9 | 4 | 2 | 1 | 1 | 1 | 0.5 | 0.5 | 0.5 | 0.5 | 0.5 | 0.5 | 9 | 0 | 0 | 0 |
| | *Escherichia coli* | 7 | 3 | 1.5 | 1 | 1 | 0.5 | 0.5 | 0.5 | 0.2 | 0.2 | 0 | 0 | 7 | 0 | 0 | 0 |
| | *Trichophyton mentagrophytes* | — | — | — | — | — | — | — | — | — | — | — | — | — | + | + | + |
| Wool muslin | *Staphylococcus aureus* | 8 | 3 | 2 | 1 | 1 | 0.5 | 0.5 | 0.5 | 0.5 | 0.5 | 0.5 | 0.5 | 8 | 0 | 0 | 0 |
| | *Escherichia coli* | 6 | 2 | 1 | 1 | 0.5 | 0.5 | 0.2 | 0.2 | 0 | 0 | 0 | 0 | 6 | 0 | 0 | 0 |
| | *Trichophyton menta-* | — | — | — | — | — | — | — | — | — | — | — | — | — | + | + | + |

TABLE 2-continued

| | | Frequency of Washing | | | | | | | | | | | | | | | |
|---|---|---|---|---|---|---|---|---|---|---|---|---|---|---|---|---|---|
| | | Fabric Treated by Invention | | | | | | | | | | | | Control | | | |
| Fabric | Bacillus | 0 | 5 | 10 | 20 | 30 | 40 | 50 | 60 | 70 | 80 | 90 | 100 | 0 | 1 | 3 | 5 |
| | *grophytes* | | | | | | | | | | | | | | | | |

Through the tests, it was found that the fabrics treated by the present invention retained their washfast and antibiosis against *Staphylococcus aureus* and *Trichophyton mentagrophytes* even after the fabrics were washed 100 times and against *Escherichia coli* even after the fabrics were washed 60–80 times. On the other hand, the controls lost their washfast and antibiotics when they were washed once.

EXAMPLE 3

Fabrics similar to those treated with the composition as described in connection with Example 1 were each washed 50 times under dry cleaning test conditions to determine their washfast and antibiotics.

Controls treated with a treatment composition similar to the composition as described in connection with Example 1 except for the exclusion of octadecyl ethylene urea therefrom were tested under the same dry cleaning test conditions as described in connection with Example 1. The results of the tests are given in the following Table 3.

TABLE 3

| | | Frequency of Washing | | | | | | | | | | | |
|---|---|---|---|---|---|---|---|---|---|---|---|---|---|
| | | Fabric Treated by Invention | | | | | | | | Control | | | |
| Fabric | Bacillus | 0 | 3 | 5 | 10 | 20 | 30 | 40 | 50 | 0 | 1 | 3 | 5 |
| Cotton broad | *Staphylococcus aureus* | 8 | 4 | 3 | 1 | 1 | 0.5 | 0.5 | 0.5 | 8 | 0 | 0 | 0 |
| | *Escherichia coli* | 6 | 3 | 2 | 1 | 0.5 | 0.5 | 0.5 | 0.5 | 6 | 0 | 0 | 0 |
| | *Trichophyton mentagrophytes* | — | — | — | — | — | — | — | — | — | + | + | + |
| Nylon | *Staphylococcus aureus* | 10 | 6 | 3 | 2 | 2 | 1 | 0.5 | 0.5 | 10 | 0 | 0 | 0 |
| | *Escherichia coli* | 8 | 5 | 3 | 1.5 | 1 | 0.5 | 0.5 | 0.5 | 8 | 0 | 0 | 0 |
| | *Trichophyton mentagrophytes* | — | — | — | — | — | — | — | — | — | + | + | + |
| Acryl | *Staphylococcus aureus* | 10 | 7 | 5 | 2 | 1.5 | 1 | 0.5 | 0.5 | 10 | 0 | 0 | 0 |
| | *Escherichia coli* | 8 | 3 | 2 | 2 | 1 | 0.5 | 0.5 | 0.5 | 8 | 0 | 0 | 0 |
| | *Trichophyton mentagrophytes* | 31 | — | — | — | — | — | — | — | — | + | + | + |
| Wool muslin | *Staphylococcus aureus* | 7 | 5 | 4 | 2 | 2 | 1 | 0.5 | 0.5 | 7 | 0 | 0 | 0 |
| | *Escherichia coli* | 6 | 3 | 3 | 2 | 1 | 0.5 | 0.5 | 0.5 | 6 | 0 | 0 | 0 |
| | *Trichophyton mentagrophytes* | — | — | — | — | — | — | — | — | — | + | + | + |

Although the fabrics treated by the present invention lost their washfast at the fiftieth dry cleaning, the fabrics still retained their antibiosis at the last dry cleaning and were not adversely affected by the action of the dry cleaning solvent employed.

On the other hand, the controls lost their washfast and antibiotics at the first dry cleaning.

The treatment of the fabric by the method of the present invention can be performed by immersing the fabric into the emulsion, for example.

It will be apparent to those skilled in the art that various changes may be made in the invention without departing from the spirit and scope of the same.

What is claimed is:

1. A method for treating a fabric by the combined use of at least one of a sterilizing compound and a mould retardation compound and a permanent water repellent and softening compound having the general formula:

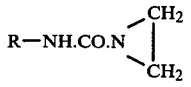

wherein R is $C_{2-18}$ alkyl group so as to impart said fabric with washfast and antibiosis which are maintained even after repeated washings.

2. A method for treating a fabric by the combined use of a sterilizing compound and a permanent water repellent and softening compound having the general formula:

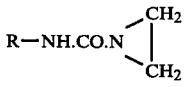

wherein R is $C_{2-18}$ alkyl group so as to impart said fabric with washfast and antibiosis which are maintained even after repeated washings.

3. A method for treating a fabric by the combined use of a mould retardation compound and a permanent water repellent and softening compound having the general formula:

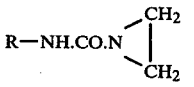

wherein R is $C_{2-18}$ alkyl group so as to impart said fabric with washfast and antibiosis which are maintained even after repeated washings.

4. A method for treating a fabric by the combined use of sterilizing and mould retardation compounds and a permanent water repellent and softening compound having the general formula:

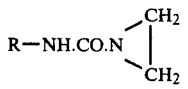

wherein R is $C_{2-18}$ alkyl group so as to impart said fabric with washfast and antibiosis which are maintained even after repeated washings.

5. The method for treating a fabric as set forth in any one of claims 1, 2, 3 and 4, in which said permanent water repellent and softening compound is a member selected from the group consisting of alkylethylene urea, octadecyl ethylene urea and isooctyl ethylene urea.

6. The method for treating a fabric as set forth in claim 5, in which said permanent water repellent and softening compound is in the form of an emulsion in water having a surface active agent added thereto.

7. The method for treating a fabric as set forth in claim 5, in which said permanent water repellent and softening compound is in the form of an emulsion in an organic solvent.

8. The method for treating a fabric as set forth in claim 5, in which said permanent water repellent and softening compound is employed in an amount of 0.1–10% by weight based on the weight of said fabric.

9. The method for treating a fabric as set forth in any one of claims 1, 2, 3 and 4, in which said fabric is a member selected from the group consisting of cotton, hemp, silk, wool and synthetic fabrics formed of fibers having hydroxyl radicals.

10. The method for treating a fabric as set forth in any one of claims 1, 2, 3 and 4, in which said fabric is a member selected from the group consisting of cotton, hemp, silk, wool and synthetic fabrics formed of fibers having amino radicals.

11. The method for treating a fabric as set forth in any one of claims 1, 2, 3 and 4, in which said sterilizing compound is a member selected from the group consisting of alkyldimethyl benzyl ammonium chloride, chlorohexadine, digluconate, p-chloro-m-xylenol and 2,4,4'-trichloro-2'-hydroxy diphenyl ether.

12. The method for treating a fabric as set forth in any one of claims 1, 2, 3 and 4, in which said mould retardation compound is a member selected from the group consisting of 2,4,5,6-tetrachloroisophthalonitrile, N(fluorodichloromethylthio) phthalimide, zinc-2-pyridimethio-1-oxide, 2-(4-thiazolyl)benzimidazole, α-bron cynnamic aldehyde, p-hydroxy benzoic acid ester, N-dimethyl-N'-phenyl-N'-(phlorochloromethyl) thiosulfamide and methoxycarbonyl and aminobenzimidasol-4-n-dedecyl bensole sulfonate.

* * * * *